US007575608B2

(12) United States Patent
Angelico et al.

(10) Patent No.: US 7,575,608 B2
(45) **Date of Patent: *Aug. 18, 2009**

(54) USE OF A NATURAL-OIL BYPRODUCT AS A REDUCED-EMISSIONS ENERGY SOURCE

(75) Inventors: Paul J. Angelico, Norfolk, MA (US); Irwin M. Heller, legal representative, Wellesley Hills, MA (US); James E. Ricci, Haverhill, MA (US)

(73) Assignee: Twin Rivers Technologies, L.P., Quincy, MA (US)

( * ) Notice: Subject to any disclaimer, the term of this patent is extended or adjusted under 35 U.S.C. 154(b) by 826 days.

This patent is subject to a terminal disclaimer.

(21) Appl. No.: 10/487,430

(22) PCT Filed: Aug. 16, 2002

(86) PCT No.: PCT/US02/26065

§ 371 (c)(1),
(2), (4) Date: Nov. 3, 2004

(87) PCT Pub. No.: WO03/018725

PCT Pub. Date: Mar. 6, 2003

(65) Prior Publication Data

US 2005/0120620 A1 Jun. 9, 2005

(51) Int. Cl.
*C10L 1/18* (2006.01)

(52) U.S. Cl. ..... 44/307; 44/385; 431/2

(58) Field of Classification Search ..... 44/307, 44/385; 431/2

See application file for complete search history.

(56) References Cited

U.S. PATENT DOCUMENTS 3,923,702 A 12/1975 Sturwold et al. ..... 252/56 S
4,159,992 A 7/1979 Miserlis ..... 260/412.6
4,342,656 A * 8/1982 Walsh ..... 210/770
4,892,560 A 1/1990 Sial ..... 44/50
5,004,533 A 4/1991 Kalnes et al. ..... 208/50
5,892,072 A 4/1999 Thode ..... 554/175

(Continued)

FOREIGN PATENT DOCUMENTS

EP 0 816 476 B1 1/1998

OTHER PUBLICATIONS

International Search Report for PCT/US02/26065, mailed Jan. 7, 2003.

(Continued)

*Primary Examiner*—Cephia D Toomer
(74) *Attorney, Agent, or Firm*—Mintz, Levin, Cohn, Ferris, Glovsky and Popeo, PC; A. Jason Mirabito; Ido Rabinovitch

(57) ABSTRACT

A natural-oil byproduct, which can be produced as a "still bottoms" byproduct of a distillation of a feed composition including an animal fat and/or vegetable oil, is used as an energy source. The natural-oil byproduct can comprise unhydrolyzed fat/oil and free fatty acids; and its emissions upon burning have substantially reduced pollutant concentrations relative to other fuels. When used as an energy source, the natural-oil byproduct can be burned alone or in combination with a traditional fuel, such as number 2 or number 6 oil or coal.

43 Claims, 5 Drawing Sheets

U.S. PATENT DOCUMENTS

| | | | | |
|---|---|---|---|---|
| 6,017,371 | A | 1/2000 | Gheysens et al. | 44/448 |
| 6,129,773 | A | 10/2000 | Killick et al. | 44/388 |
| 6,193,766 | B1 | 2/2001 | Jordan | 44/308 |
| 6,210,452 | B1 | 4/2001 | Su | 44/410 |
| 6,238,551 | B1 | 5/2001 | Sherman et al. | 208/181 |
| 6,740,134 | B2 * | 5/2004 | Angelico et al. | 44/307 |

OTHER PUBLICATIONS

Written Opinion for PCT/US02/26065, mailed Nov. 13, 2003.

* cited by examiner

USE OF A NATURAL-OIL BYPRODUCT AS A REDUCED-EMISSIONS ENERGY SOURCE

BACKGROUND

The ecological importance of clean air is as evident as our need to breathe. Nevertheless, the demands of an industrialized society and the consequent burning of fuel for energy tends to compromise air quality. Existing fuels that are burned in boiler systems to produce steam for heating and power supply include distillate (number 2) fuel oil, residual (number 6) fuel oil, blended distillate and residual fuel oil, and coal. These fuels typically release substantial quantities of harmful pollutants, such as sulfur oxides, nitrogen oxides and carbon monoxide. Moreover, each of these fuels is subject to supply shortages as societal energy demands increase. In fact, dwindling mineral oil reserves are a primary factor in the ongoing energy-supply crisis.

Clean air legislation, such as the Clean Air Act in the United States, has been enacted to control the amount of various chemicals released into the atmosphere in an effort to protect human health and the environment. At a local or regional level, industry is typically regulated by state environmental protection agencies that set limits as to the amounts of airborne pollutants that can be emitted from a given facility.

Many existing energy sources, particularly mineral oils (e.g., petroleum-based fuels), release substantial amounts of pollutants, such as nitrogen oxides ($NO_x$), sulfur oxides ($SO_x$), carbon monoxide (CO) and particulate matter (PM) upon burning. These pollutants cause respiratory diseases, other human ailments and, over time, death. These pollutants also poison the environment via acid rain, ground-level ozone and greenhouse-gas-induced global warning.

As energy demands increase, the pressures, conflicts and costs involved in supplying that energy without exacerbating these health and environmental problems and in complying with clean air regulations become increasingly pressing.

SUMMARY

Methods described below are capable of producing energy with substantially reduced concentrations of pollutants, such as $NO_x$, $SO_x$, CO, and PM, in the resultant gaseous emissions by utilizing, as an energy source, a natural-oil byproduct of fatty-acid manufacturing.

The natural-oil byproduct can be produced by vaporizing a natural fatty-acid composition from a feed composition including an animal fat and/or vegetable oil in a distillation process, wherein the feed composition is first hydrolyzed to remove glycerine. The feed composition (also referred to as a "natural-oil composition") can be in a rendered, crude or refined form. The natural-oil byproduct can then be processed and burned, either alone or mixed with another energy source, to release energy that is then harnessed to drive a process, such as boiling water in the furnace of a boiler to produce steam.

The natural-oil byproduct can include free fatty acid and unhydrolyzed fats/oils as primary constituents. The terms, "fat" and "oil," are generally used interchangeably herein. The term, "fat," is commonly used in reference to animal products, while the term, "oil," is commonly used in reference to vegetable products. However, recitations of either "fat" or "oil," as in "natural-oil byproduct," can refer to a byproduct of either animal fat or vegetable oil or a combination of the two.

Likewise, recitation of an "unhydrolyzed fat/oil" refers to an unhydrolyzed animal fat, an unhydrolyzed vegetable oil or a combination of the two.

The natural-oil byproduct can also include unsaponifiable impurities and oxidized, polymerized fatty materials, typically at concentrations that are substantially smaller than those of the free fatty acids and unhydrolyzed fats/oils. In one embodiment, the natural-oil byproduct comprises about 20% to about 50% free fatty acid, about 20% to about 60% unhydrolyzed fat/oil, about 2% to about 5% unsaponifiable impurities and about 2% to about 7% oxidized, polymerized fatty materials, wherein all percentages are by weight. The fatty acid that is vaporized during distillation can be at least about 90% of the initial composition, by weight. Due to the nature of the natural oils from which it is derived, the natural-oil byproduct, unlike byproducts of petroleum and other mineral oils, can be substantially free (allowing for trace impurities) of sulfur compounds, nitrogen compounds and volatile organic compounds. In particular embodiments, the natural oil can be coconut oil, soybean oil, canola oil, sunflower oil, linseed oil, tallow and animal greases.

Additionally, the natural-oil byproduct can be supplied to others who burn it with another fuel to release and harness energy, wherein the addition of the natural-oil byproduct provides the user with the benefits of reduced pollutant emissions. In particular embodiments, the natural-oil byproduct is burned in an open-flame environment, such as a "pulverized-coal-combustion" furnace. In one example, the natural-oil byproduct can be supplied to a power plant, where the natural-oil byproduct is burned alone or in combination with another fuel to generate electric power.

By substituting the natural-oil byproduct, in whole or in part, for another fuel (such as number 2 fuel oil, number 6 fuel oil, coal and combinations thereof), an energy producer can achieve a substantial decrease in the emission of nitrogen oxides, sulfur oxides, carbon monoxide and particulate matter. Particular advantages can be achieved by substituting the natural-oil byproduct for the other fuel(s) in situations where a desired level of energy production cannot be achieved using only the other fuel(s) without violating pollutant-emission levels established by a regulatory agency. Pollutant-emission levels can be maintained at or below regulated limits by evaluating the respective emission concentrations from the natural-oil byproduct and from the other fuel(s) and calculating the concentration ratio of the byproduct and the fuel(s) that will produce desired emission concentrations without changing the overall energy input of the combined fuel.

Figure 1:
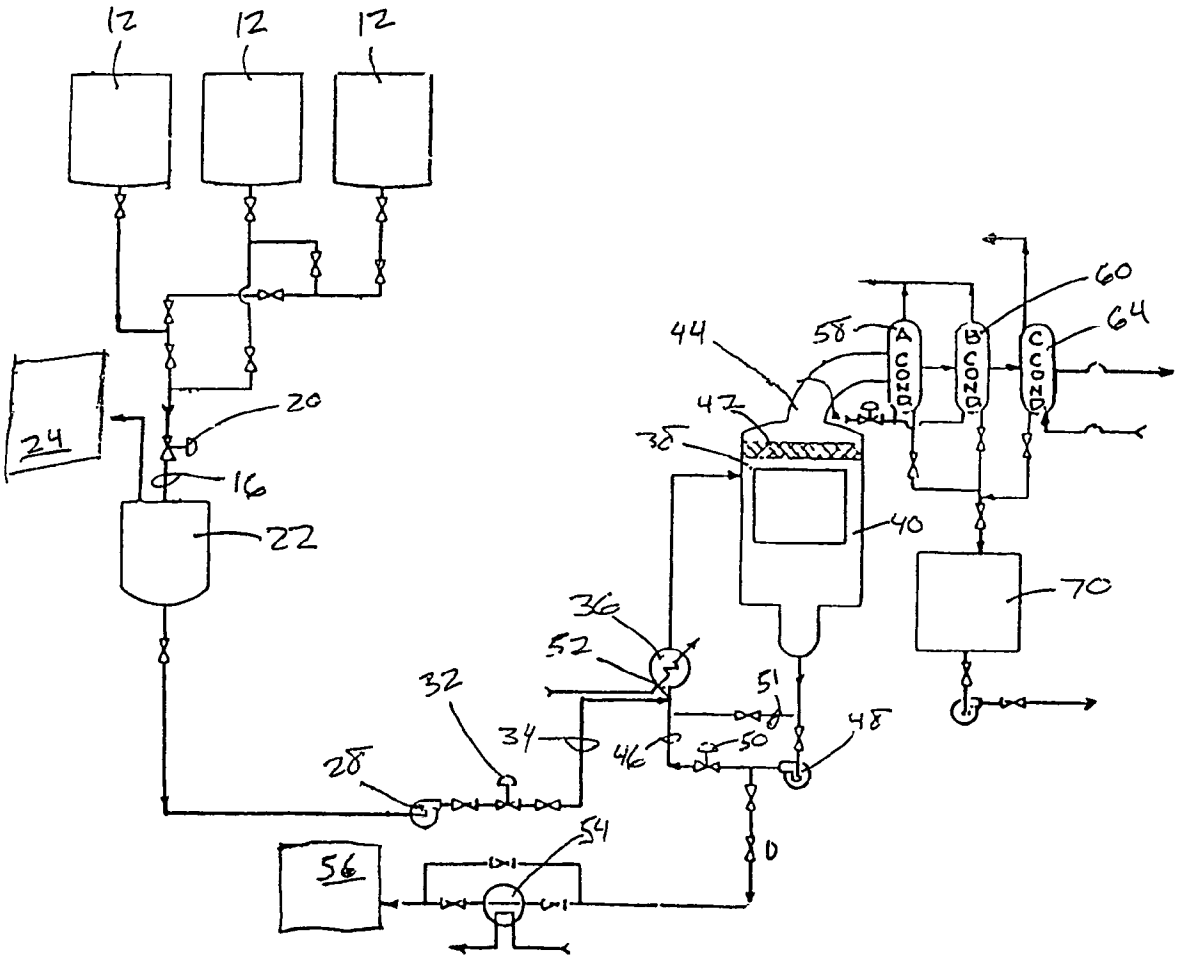
FIG. 1 is a schematic drawing of a still apparatus used to produce the natural-oil byproduct.

The foregoing and other features and advantages of the invention will be apparent from the following, more-particular description. In the accompanying drawings, like reference characters refer to the same or similar parts throughout the different views. The drawings are not necessarily to scale, emphasis instead being placed upon illustrating particular principles, discussed below.

DETAILED DESCRIPTION

A "natural-oil byproduct" is a composition derived from a natural-oil (feed) composition during distillation. The natural-oil composition typically is first hydrolyzed, in accordance with known methods of hydrolysis, to remove glycerine. The natural-oil composition is then distilled to separate fatty acids, usually of preferred chain lengths (e.g., C 8-18) from the natural-oil composition for various final product applications such as soaps, detergents, softeners, rubber and lubricants. These fatty acids are vaporized from the natural-oil composition, leaving behind a natural-oil byproduct, also known as "still bottoms" or "tailings."

The procedures for deriving the natural-oil byproduct can be carried out in accordance with known methods for deriving fatty acids for forming soap and other final products. Examples of methods for deriving fatty acids for forming soap are described in U.S. Pat. No. 5,892,072 and in U.S. Pat. No. 4,159,992, both of which are incorporated herein by reference in their entirety. The use of similar methods to derive fatty acids has often been tailored such that at least 90% of the natural-oil composition is vaporized in the distillation process. In previous methods, such as those for making soap, the still bottoms were essentially viewed as a waste product, though they were sometimes used as a low-cost animal feed additive. The still bottoms typically include unhydrolyzed fat/oil and high-molecular-weight impurities that were present in the natural-oil composition.

Separation of the natural-oil byproduct from the vaporized fatty-acid composition in the distillation process makes a marked improvement in the color and the odor of the vaporized fatty acid. The natural-oil byproduct would likewise have an adverse effect on the color and odor stability of soap and other fatty-acid final products. Consequently, the distillation process makes it possible to make high-quality final products from lower-quality raw materials than would be possible if distillation were not used to at least partially separate the fatty acid from other components in the feed.

Figure 2:
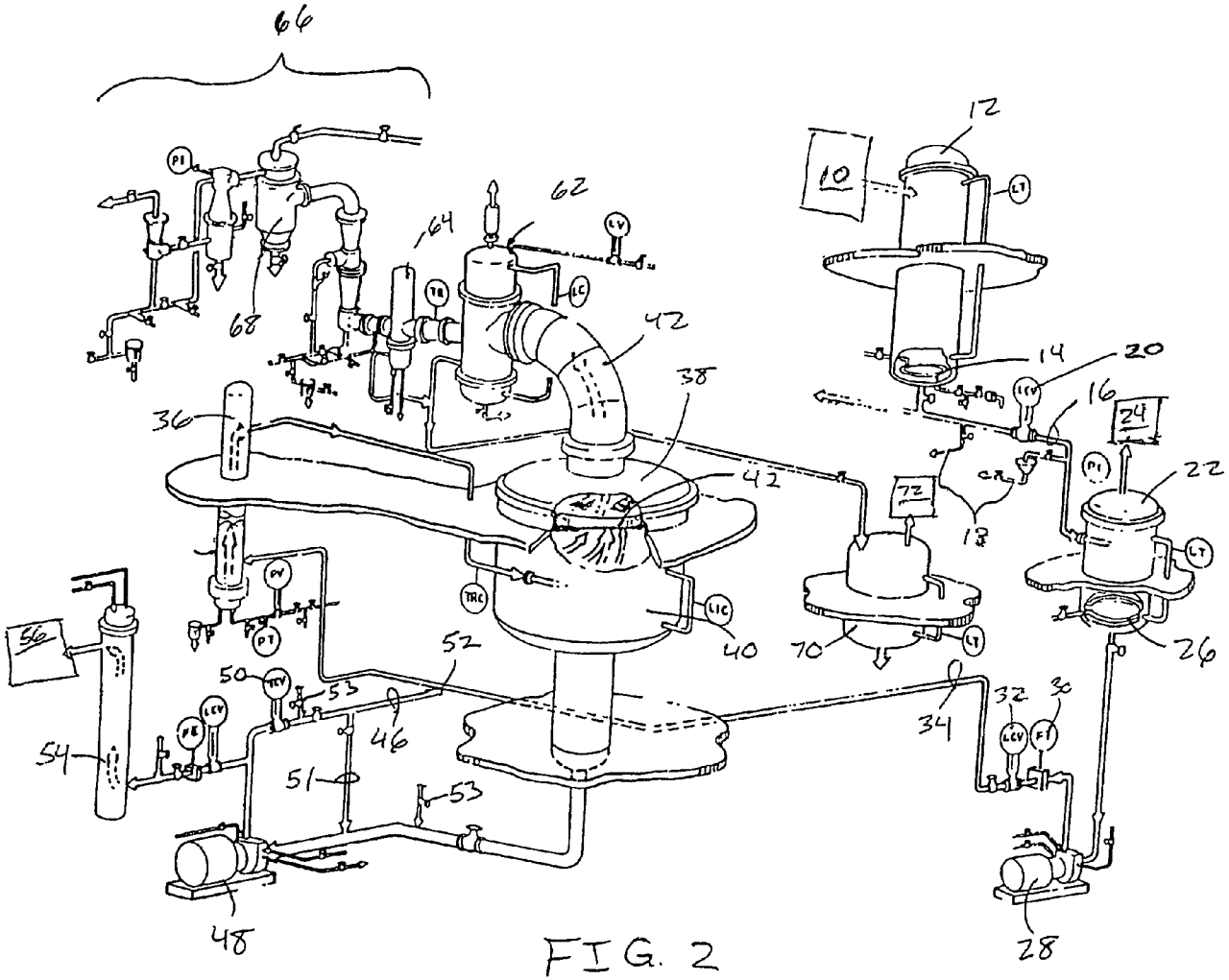
FIG. 2 is a partially schematic perspective drawing illustrating various components of a still apparatus, much like that of FIG. 1, used to produce the natural-oil byproduct.

A distillation system for separating a high-grade fatty-acid composition from a natural-oil byproduct is illustrated in FIG. 1, and another is shown in FIG. 2. These drawings illustrate two particular embodiments of apparatus for producing a natural-oil byproduct; however, these embodiments are intended to be merely illustrative; and broader aspects of the invention, relating to the production of the natural-oil byproduct, are not intended to be limited to the use of the particular apparatus illustrated.

The distillation process is simply a physical separation of the normally desirable fatty-acid products from the normally undesirable natural-oil byproducts that are present in the natural-oil composition. Distillation is performed by converting fatty acids to vapor, thereby separating the vaporized fatty acids from the natural-oil byproducts, which remain in liquid form, and then condensing the fatty-acid vapors (converting the vapors back to liquid).

The distillation process begins at a flash tank 10 (shown schematically in FIG. 2). The flash tank 10 is a hydrolyzer column, wherein a composition having a high concentration of fatty acids is derived from a composition comprising natural oil, such as coconut oil and/or tallow; in this embodiment, the fatty-acid composition rises to the top of the hydrolyzer column under pressure and high temperature. When the pressure of the fatty-acid composition is then dropped to atmospheric pressure, most of the dissolved water boils off. This partially dried, fatty-acid composition is then transported from the flash tank 10 to a still-feed tank 12, which functions as a wide spot in the line and provides surge storage. In the embodiment of FIG. 1, multiple still-feed tanks 12 are connected in parallel with the still feed apparatus. The feed is heated in the still-feed tank 12 via a steam-heated coil 14 (shown in FIG. 2) at the base of the tank 12. Depending on the source, the steam-heated coil 14 may be at a temperature in the range of 100° to 300° F. (38° to 149° C.).

From the still-feed tank 12, the fatty-acid composition is transported through a pipe 16 to a vacuum dryer 22. Coupled with the pipe 16 between the still-feed tank 12 and vacuum dryer 22 are moisture drains 18 (shown in FIG. 2) and a level control valve 20, respectively used to drain moisture from the feed and to control flow. The vacuum dryer 22 is coupled with a vacuum 24 and can be heated via a steam-heated coil 26, with the steam, in one embodiment, at 150 pounds pressure and at 200° F. (93° C.). Under the vacuum of the vacuum dryer 22, most of the remaining water in the stock boils off.

The dried, fatty-acid composition, which is still a liquid, is then pumped via pump 28 from the vacuum dryer 22 through a flow transmitter 30 and level control valve 32 (shown in FIG. 2), which collectively regulate flow, through a pipe 34 to a high-pressure heat exchanger 36. The heat exchanger 36 is heated with steam at 800 pounds pressure at about 400° F. (204° C.). The feed then is passed into a large flash still 38. The flash still 38 is a large tank operating under a vacuum, where vaporized fatty acid at its boiling point separates (flashes) from the liquid material in the feed. The fatty-acid composition enters the still 38 through a nozzle directed along the inside wall of the still pot 40. This type of injection (referred to as tangential entry) causes the hot stock to swirl and fan out along the inside wall of the still pot 40, thus exposing a large surface area for evaporation. The still pot 40 is equipped with a knit mesh entrainment separator 42 covering the vapor line 44 leaving the still pot 40. The knit mesh entrainment separator 42 traps droplets of liquid in the vapor and returns the liquid to the still pot 40.

The portion of the raw feed that does not evaporate upon injection into the still 38 collects in the bottom of the pot 40 as "still bottoms." The still bottoms are pumped through recycle loop 46 via pump 48 through a level control valve 50 from the bottom of the still pot 40. The recycled still bottoms are then mixed with new raw feed coming into the system at juncture 52, passed through the heat exchanger 36, and re-injected into the still 38. Approximately 8 pounds (3.6 kg) of this material, referred to as still bottoms or natural-oil byproduct, is recycled for every pound (0.45 kg) of new raw feed entering the system. When the level of the natural-oil byproduct in the still pot 40 builds to above the desired operating level, the natural-oil byproduct is removed from the recycle loop 46, cooled in a water-cooled heat exchanger 54 and diverted to dedicated storage 56. Pipe 51 is used as a bypass around the pump 48 at startup. Steam inputs 53 (shown in FIG. 2) are used in the pipes to clear them during brand changeovers.

The natural-oil byproduct typically includes from about 20% to about 50% (e.g., 30%) free fatty acid, from about 20% to about 70% (e.g., 60%) unhydrolyzed fat/oil, from about 2% to about 5% (e.g., 4%) unsaponifiable impurities (materials other than fat or oil, such as plastics and metals, that do not boil), and from about 2% to about 7% (e.g., 6%) oxidized, polymerized fatty materials. The particular composition of the natural-oil byproduct will be a function of the composition of the natural-oil composition as well as of the parameters of the distillation process. From storage 56, the natural-oil byproduct is loaded into either railcars or trucks or transferred directly for delivery to customers or internally for use as an energy source.

The fatty-acid vapor that passes through the entrainment separator flows into a group of condensers. The first of these condensers, which condenses the bulk of the product, is cooled with boiling water. In the system of FIG. 1, the boiling water condensers are separate and are referred to as an "A" condenser 58 and a "B" condenser 60. The generated steam from these condensers is recycled back to the boiler house. In the system of FIG. 2, the function of the A and B condenser has been combined into a single unit described as a combined "A-B" condenser 62. The final condenser in the group is referred to as a "C" condenser 64. The C condenser 64 is cooled with water at 120° F. (49° C.). At the temperatures present in the C condenser 64, short-chain fatty acids, which stay in the vapor passing through the A and B condensers, are condensed. By condensing these short-chain, very-volatile, fatty acids, the load on the ejector system 66 (shown in FIG. 2) can be minimized. Any fatty acid that gets past the C condenser 64 is condensed in the barometric condenser 68 and ends up in the barometric hot well. Usually, the fat collected in the barometric hot well ends up in an accumulations tank. The condensed fatty-acid distillate from all three condensers is collected in a distillate receiver 70 coupled with a vacuum source 72. From the distillate receiver 70, the distilled product can be cooled and sent to storage or to subsequent processing before being used to form soap or other final products.

An energy producer (e.g., a boiler operator) can substitute the natural-oil byproduct, in whole or in part, for another fuel, such as number 2 fuel oil, number 6 fuel oil, coal and combinations thereof, as an energy source to be burned in the furnace of the boiler. In so doing, the energy producer can achieve a substantial decrease in the amount of nitrogen oxides, sulfur oxides, carbon monoxide and particulate matter emitted as a consequence of burning the fuels. In some situations, a desired level of energy production cannot be achieved using only a combination of number 2 and number 6 fuel oil, for example, without violating regulated pollutant-emission limitations.

Pollutant-emission levels can be maintained at or below regulated limits by evaluating the respective pollutant-emission concentrations produced by the natural-oil byproduct and by the other fuel(s). The energy producer can then calculate the concentration ratio of the byproduct and the fuel(s) that will produce a desired emission concentration (e.g., an emission concentration within the regulated limit) for one or more pollutants and then burn at least that much byproduct in combination with the other fuel(s). The added concentration of the natural-oil byproduct is typically calculated based on its percentage heat input as a function of the overall (fixed) heat input of the combined fuel. For some pollutants, such as sulfur dioxide, the emission concentration can drop proportionally to the percent heat input of the natural-oil byproduct in the fuel mixture. For other pollutants, such as nitrogen oxides, the emission concentration can drop by percentages much greater than the percent heat input of the natural-oil byproduct.

Consequently, as shown in tests, described below, a reduction of approximately 30% in sulfur dioxide emission (relative to the $SO_2$ emitted by a fuel with 0% natural-oil byproduct) can be achieved by substituting sufficient natural-oil byproduct into the fuel to provide 30% of the overall heat input. Meanwhile, a reduction in $NO_x$ emissions of approximately 65% (relative to a fuel with 0% natural-oil byproduct) can be achieved by substituting sufficient natural-oil byproduct to provide 30% of the fuel's overall heat input. The functional relationship between the concentration of the natural-oil byproduct and the resultant $NO_x$ and $SO_2$ emissions in this embodiment of the method are further reported and detailed in the exemplification section, below.

The energy produced by the natural-oil byproduct is competitive with that produced by other fuel sources. A sampling of batches of natural-oil byproduct, produced in accordance with the methods described above, showed an average of approximately 130,000 Btu/gallon for the natural-oil byproduct. The energy produced by number 6 oil is somewhat higher (typically about 150,000 Btu/gallon), while the energy produced by number 2 oil is almost the same (typically about 135,000 Btu/gallon). Depending on the particular ingredients in the feed composition and the parameters of the distillation process, the energy produced by the natural-oil byproduct may be somewhat higher or lower in other embodiments.

Exemplification

I. Test #1

Measurements were taken of boiler stack emissions from the burning of two separate energy-sources. The first energy source was a mix of 80% number 6 fuel oil and 20% number 2 fuel oil. The second energy source was a 100% concentration of a natural-oil byproduct produced via the methods described above from a natural-oil composition comprising tallow and coconut oil.

The two energy sources were separately burned in the furnace of a boiler. The emissions from the boiler for the natural-oil byproduct showed the following reductions compared with the emissions for the composition comprising 80% number 6 fuel oil and 20% number 2 fuel oil:

66% reduction in $NO_x$,

88% reduction in $SO_x$,

100% reduction in CO, and

78% reduction in PM.

II. Test #2

A. Procedure

Figure 3:
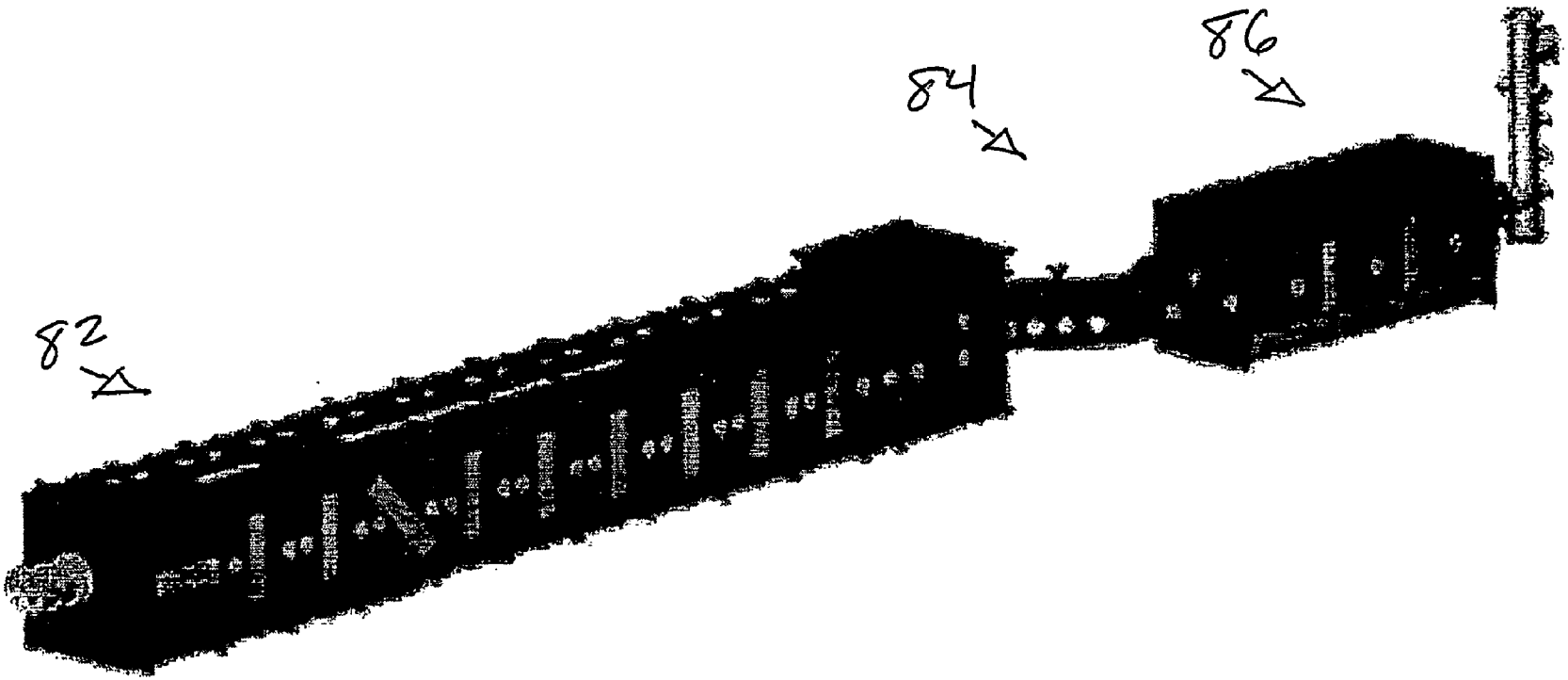
FIG. 3 is an illustration of a combustion furnace used to test emissions from coal co-fired with the natural-oil byproduct.

A natural-oil byproduct (as described above) was co-fired (i.e., burned in combination) with pulverized coal in a pilot-scale, pulverized-coal combustion test furnace. More specifically, the test furnace was a nominal 5 MMBtu/hr (1.5 MW) furnace designed to simulate commercial combustion conditions. The furnace, illustrated in FIG. 3, was modular in design and was provided with access ports for visual observation, fuel and/or air injection, product sampling, and species/temperature profiling. The feed passed from left to right through the burner (reactor) section 82, through the transition section 84 and finally through the cooling section 86.

The inner dimensions of the horizontal-fired combustion furnace were 110×110 cm (42×42 inches) square and 12.2 m (40 feet) long. The walls of the furnace were provided with multiple-layered insulation to reduce the temperature from about 1650° C. (3000° F.) on the fire side to below 60° C. (140° F.) on the shell side.

The overall combustion apparatus included an air supply system, a water supply and cooling system, the combustion furnace, fuel supply systems, a flue-gas cooling chamber, a scrubber, and an induced-draft fan and stack. An instrumented control room was provided adjacent to the apparatus and was used to control the operation of the furnace and to record and analyze data.

The burner in the combustion furnace included independently controllable primary, secondary and tertiary air inputs. Over-fire air was injected downstream from these inputs.

The feed was injected into the furnace through the center of the burner. The coal injector was in the form of a 3.8-cm (1.5-inch) diameter pipe inside a 7.6-cm (3-inch) diameter pipe. Coal was fed through the annulus between the walls of the two pipes; the 3.8-cm pipe acted as a bluff body.

A dual-fluid atomizing nozzle for injecting the natural-oil byproduct and air was inserted through the 3.8-cm bluff body pipe. The natural-oil byproduct and air were premixed and passed through six small holes in the injector tip of the nozzle. By this design, the natural-oil byproduct was well atomized and fed directly into the center of the coal stream.

The natural-oil byproduct was fed from two 10-gallon pressure tanks connected in parallel. Compressed air was applied to the tanks, which forced the natural-oil byproduct out from the tanks, through a digital flow-meter and into the burner.

1. Co-Firing Natural-Oil Byproduct, No Air Staging

In this test, natural-oil byproduct (as described above) was co-fired with coal in the above-described furnace. No operational problems were encountered, and it was found that the flow rate of the natural-oil byproduct could be reliably controlled.

The operating conditions in this test were as follows:

Primary fuel: Illinois #5 coal

Co-firing fuel: natural-oil byproduct

Total heat input: 4 million Btu/hr

Burner conditions:

Primary air: 17.4% of burner air, SR=0.20

Secondary air: 27.5% of burner air, SR=0.32

Tertiary air: 55.1% of burner air, SR=0.63

Total burner air input: SR=1.15

Over-fire air: none

Total air: SR=1.15

Co-firing ratios (heat %): 0, 2½, 5, 10, 15, 20, 30, 40, 50

The "SR" indications, above, represent the amount of air provided relative to the amount theoretically needed for combustion (e.g., an SR of 1.15 indicates that air was provided at a concentration 15% greater than theoretically necessary for complete combustion).

The furnace was taken off natural-gas standby (approximately 2 MMBtu/hr) and started on pure coal (156 kg./hr., 4 MMBtu/hr) to establish a baseline for the tests. After approximately 30 minutes of operation on coal, emissions data were logged and co-firing of natural-oil byproduct began. The coal feed rate was reduced by 10% to 141 kg/hr (310 lb/hr), and natural-oil byproduct was injected into the burner at 11.9 1/hr (3.14 gal/hr), corresponding to 0.4 MMBtu/hr heat input. The air feed was decreased slightly (approx. 3%) to maintain constant $O_2$ concentration in the flue gas. The system stabilized after a few minutes, and conditions were maintained for approximately 15 minutes to allow for collection of emissions data.

The co-firing ratio was subsequently increased to 20%, 30%, 40% and 50%, wherein the percentages represent the percent heat input provided by the natural-oil byproduct, with the balance provided by the coal. For each increase in the ratio, the coal, natural-oil byproduct and air flow rates were adjusted; and conditions were maintained for approximately 15 minutes. The feed system for the natural-oil byproduct was roughly at maximum capacity at 50% co-firing (59.4 1/hr natural-oil byproduct), so higher co-firing rates were not attempted. Though, of course, higher ratios can be achieved by using multiple feeds or by using a higher-volume feed for the natural-oil byproduct.

For all conditions, data were logged at the standard sampling position, section 6 of the burner section, which corresponds to about 2 seconds residence time (representative of that in an industrial pulverized coal furnace). $NO_x$, CO, $CO_2$ and $O_2$ data at the reactor exit, after section 12 of the burner section (approximately 5 seconds residence time), were also logged. However, during the first run through, data at the reactor exit were not logged at co-firing ratios of 10% and 20%. Therefore, after 50% co-firing, the 20% and 10% co-firing conditions were repeated and samples were analyzed at section 6 and at the reactor exit. The $NO_x$ values from section 6 during the second samplings differed by 5.8% and 1.2% from the original samplings for 20% and 10% co-firing, respectively, indicating the good repeatability of operation.

A preliminary examination of the data revealed a significant effect on $NO_x$ emissions at low co-firing ratios. At 10% co-firing, $NO_x$ emissions dropped by approximately 22% from 474 ppm to 370 ppm (adjusted to 3% $O_2$ in flue gas). Therefore, additional data were taken at 5%, 15% and then 2.5% co-firing.

Finally, co-firing was stopped, and the furnace was again run at 4 MMBtu/hr on pure coal. Emissions data were again taken to confirm the coal baseline. $NO_x$ emissions for the second baseline run were slightly higher (6.1%) than in the original. This is believed to be due, at least in part, to the fact that the furnace was about 38° C. (about 100° F.) hotter in section 6 during the second baseline run.

2. Co-Firing Natural-Oil Byproduct, Staged (Burner SR=0.85)

This part of the test was similar to the part described above in part 1, except that the air input to the furnace was staged by feeding over-fire air approximately 65% of the way to the sampling port in an attempt to make conditions more representative of those in an industrial furnace firing under low-$NO_x$ conditions.

The operating conditions in this test were as follows:

Primary fuel: Illinois #5 coal

Co-firing fuel: natural-oil byproduct

Total heat input: 4 million Btu/hr

Burner conditions:

Primary air: 24% of burner air, SR=0.20

Secondary air: 25% of burner air, SR=0.22

Tertiary air: 51% of burner air, SR=0.43

Total burner air input: SR=0.85

Over-fire air: SR=0.30

Total air: SR=1.15

Co-firing ratios (heat %): 0, 2½, 5, 10, 15, 20, 30, 40, 50

Baseline establishment and co-firing were conducted using essentially the same procedures as in part 1. In this test, however, co-firing was successively increased from 0% to 50% (in the order listed above), and gas samples were taken at section 6 and at the furnace exit for all conditions the first time through. After co-firing at 50%, the coal baseline was repeated.

B. Results

1. Co-Firing Natural-Oil Byproduct, No Air Staging a) $NO_x$ Emissions:

The concentrations of $NO_x$ measured at section 6 of the burner are presented in the table, below.

| Byproduct feed (% of fuel) | $NO_x$, ppm @ 3% $O_2$ | Reduction (%) |
|---|---|---|
| 0% | 474 | 0% |
| 2.5% | 420 | 11% |
| 5% | 402 | 15% |
| 10% | 370 | 22% |
| 15% | 321 | 32% |
| 20% | 281 | 41% |
| 30% | 248 | 48% |
| 40% | 269 | 43% |
| 50% | 312 | 34% |

Figure 4:
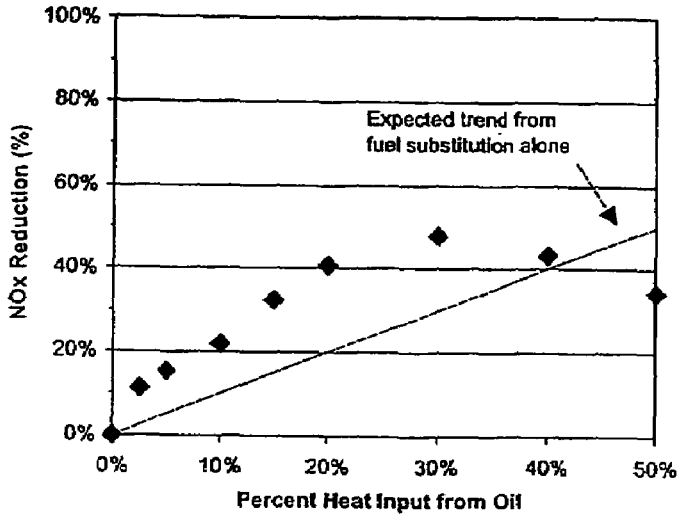
FIG. 4 is a chart plotting $NO_x$ reduction as a function of the percent heat input from the natural-oil byproduct in a test conducted without air staging using the furnace illustrated in FIG. 3.

The degree of $NO_x$ reduction at different co-firing ratios is also presented and plotted in FIG. 4. The diagonal, dashed line in this chart and others depicts the degree of emission reduction that would be expected from substitution of coal with natural-oil byproduct containing no nitrogen, assuming that all $NO_x$ stems from fuel-bound nitrogen, which is a limiting-case assumption; in reality, the $NO_x$ from fuel-bound nitrogen will represent 80% or less of the overall $NO_x$ emissions.

Clearly, substituting a portion of the coal with the natural-oil byproduct has a positive effect on $NO_x$ reduction. For un-staged combustion, maximum $NO_x$ reduction was experienced at 30% co-firing for the conditions tested. $NO_x$ was reduced by 48%, from 474 ppm on pure coal to 248 ppm with 30% co-firing. At ratios less than 30%, the degree of $NO_x$ reduction is significantly higher than one would expect from simple fuel substitution. Substitution of just 2.5% of the coal gave an 11% decrease in $NO_x$.

b) $SO_2$

For pulverized coal combustion, essentially all sulfur introduced into the system is converted to $SO_2$ and no reduction effect beyond that from fuel substitution is anticipated The concentrations of $SO_2$ measured in section 6 for different co-firing ratios are presented in the table, below.

| Byproduct feed (% of fuel) | $SO_2$, ppm @ 3% $O_2$ | Reduction (%) |
|---|---|---|
| 0% | 2670 | 0% |
| 2.5% | 2378 | 11% |
| 5% | 2288 | 14% |
| 10% | 2142 | 20% |
| 15% | 2010 | 25% |
| 20% | 1884 | 29% |
| 30% | 1511 | 43% |
| 40% | 1384 | 48% |
| 50% | 1220 | 54% |

Figure 5:
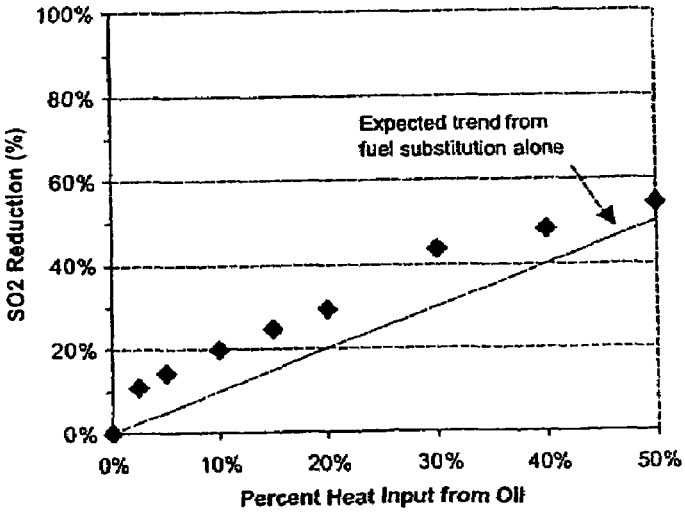
FIG. 5 is a chart plotting $SO_2$ reduction as a function of the percent heat input from the natural-oil byproduct in a test conducted without air staging using the furnace illustrated in FIG. 3.

The degree of $SO_2$ reduction is also given and plotted in the chart provided as FIG. 5.

It may appear from the table and chart that there is a general $SO_2$ reduction effect, with 10 percent units more reduction than would be expected from fuel substitution alone. Given the predictable behavior of sulfur in pulverized coal combustion, it is doubtful that such a general reduction effect exists. More likely, the higher $SO_2$ reduction results from an anomaly in the data. The baseline data point at 0% co-firing was the very first $SO_2$ measurement made during the tests and may have been comparatively high. Another possible explanation could be that the degree of sample dilution increased after the baseline run. The other tests did not display the same general reduction effect observed in FIG. 5.

2. Co-Firing Natural-Oil Byproduct, Staged (Burner SR=0.85)

a) $NO_x$ Emissions:

The following table shows the $NO_x$ concentrations and amount of $NO_x$ reduction when co-firing natural-oil byproduct and staging the air introduction.

| Byproduct feed (% of fuel) | $NO_x$, ppm @ 3% $O_2$ | Reduction (%) |
|---|---|---|
| 0% | 409 | 0% |
| 2.5% | 380 | 7% |
| 5% | 333 | 18% |
| 10% | 307 | 25% |
| 15% | 250 | 39% |
| 20% | 217 | 47% |
| 30% | 144 | 65% |
| 40% | 131 | 68% |
| 50% | 123 | 70% |

Figure 6:
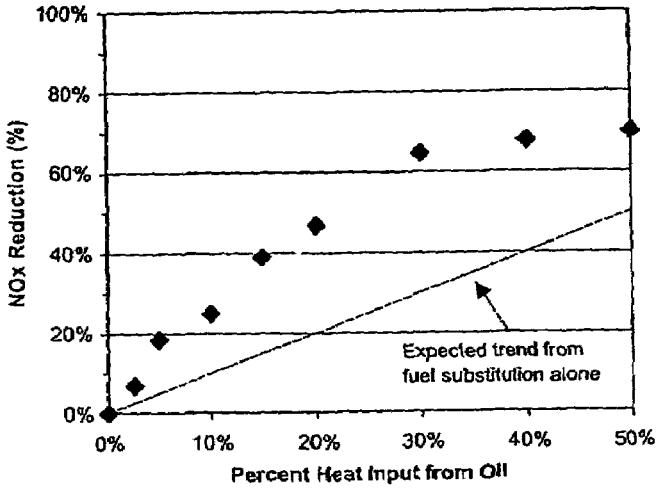
FIG. 6 is a chart plotting $NO_x$ reduction as a function of the percent heat input from the natural-oil byproduct in a test conducted with air staging using the furnace illustrated in FIG. 3.
Figure 7:
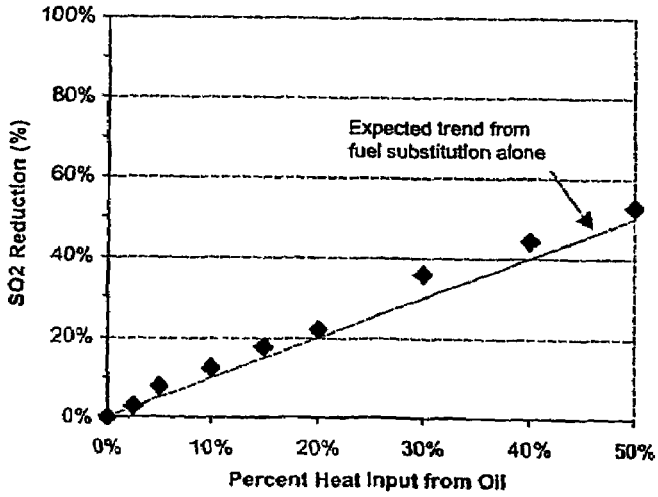
FIG. 7 is a chart plotting $SO_2$ reduction as a function of the percent heat input from the natural-oil byproduct in a test conducted with air staging using the furnace illustrated in FIG. 3.

These data are also plotted in FIG. 6. There was a marked decrease over the entire co-firing range tested (0-50%), well beyond what would result from fuel substitution. Between 0% and 30% co-firing, the decrease was particularly significant With just 10% co-firing, $NO_x$ decreased by 25%. With 20% co-firing $NO_x$ was approximately half that on coal alone. With higher feed concentrations of natural-oil byproduct, $NO_x$ continued to decrease, but the effect was less pronounced above 30%.

b) $SO_2$ Emissions:

The $SO_2$ concentrations and degree of reduction during co-firing of natural-oil byproduct during staged combustion are shown in the table, below, and plotted in FIG. 7.

| Byproduct feed (% of fuel) | $SO_2$, ppm @ 3% $O_2$ | Reduction (%) |
|---|---|---|
| 0% | 2732 | 0% |
| 2.5% | 2654 | 3% |
| 5% | 2513 | 8% |
| 10% | 2388 | 13% |
| 15% | 2243 | 18% |
| 20% | 2127 | 22% |
| 30% | 1752 | 36% |
| 40% | 1518 | 44% |
| 50% | 1286 | 53% |

The degree of $SO_2$ reduction agrees with that which is expected based on fuel substitution alone.

C. Summary and Conclusion

In the test, above, $NO_x$ reduction was excellent under staged conditions for the natural-oil byproduct. The strongest reduction effect (relative to NO emissions from simply reducing fuel nitrogen content) was observed at low natural-oil-byproduct input ratios (less than 20%). Under the conditions tested, $NO_x$ emission was roughly cut in half by displacing 20% of the coal with the natural-oil byproduct.

$SO_2$ emission was also reduced by displacing a portion of the coal with the natural-oil byproduct. This effect was simply a result of substituting the sulfur-bearing coal with a fuel that has essentially no sulfur.

While this invention has been shown and described with references to particular embodiments thereof, those skilled in the art will understand that various changes in form and details may be made therein without departing from the scope of the invention, which is limited only by the following claims.

What is claimed is:

1. A clean-emissions method for generating energy comprising the steps of:

vaporizing a high-grade fatty-acid composition via distillation from a feed composition including an animal fat, a vegetable oil, or a combination thereof, leaving a non-vaporized natural-oil byproduct;

determining the ratio of the natural-oil byproduct to another fuel that will produce an emission of at least one pollutant chosen from nitrogen oxides, sulfur oxides, carbon monoxide and particulate matter at a level at which a benefit is provided under a pollution-emission regulation established by a regulatory agency;

burning the natural-oil byproduct to release energy in a furnace in which the natural-oil byproduct is substituted for the other fuel to produce a natural-oil-byproduct-to-other-fuel ratio at least as great as the determined ratio, wherein emission of the pollutant would be above this level and access to the benefit precluded if a sufficient amount of the other fuel alone were burned in the furnace to release the same amount of energy; and harnessing energy released by burning the natural-oil byproduct to drive a process.

2. The method of claim 1, wherein the ratio of the natural-oil byproduct to the other fuel that will produce emitted pollutant concentrations within established limits is determined, and at least that proportion of natural-oil byproduct is burned in combination with the other fuel.

3. The method of claim 1, wherein the natural-oil byproduct is substituted in part, but not entirely for a fuel from the following group: distillate number 2 fuel oil, residual number 6 fuel oil, and coal.

4. The method of claim 1, further comprising the step of hydrolyzing the feed composition to remove glycerine before distillation.

5. The method of claim 1, wherein the natural-oil byproduct comprises free fatty acid and unhydrolyzed fat/oil.

6. The method of claim 5, wherein the natural-oil byproduct further comprises unsaponifiable impurities and oxidized, polymerized fatty materials.

7. The method of claim 5, wherein the natural-oil byproduct comprises about 20% to about 50% by weight free fatty acid and from about 20% to about 70% by weight unhydrolyzed fat/oil.

8. The method of claim 7, wherein the natural-oil byproduct further comprises about 2% to about 5% by weight unsaponifiable impurities and about 2% to about 7% by weight oxidized, polymerized fatty materials.

9. The method of claim 1, wherein the natural-oil byproduct is substantially free of sulfur compounds and nitrogen compounds.

10. The method of claim 1, wherein the feed composition comprises at least one of the following: coconut oil, soybean oil, canola oil, sunflower oil, linseed oil, tallow and animal greases.

11. The method of claim 1, wherein the distilled, high-grade fatty-acid composition comprises at least about 90% of the distillation feed material by weight fatty acid.

12. The method of claim 1, wherein the furnace is in a boiler.

13. A clean-emissions method for generating energy comprising the steps of:

burning a natural-oil byproduct comprising about 20% to about 40% by weight free fatty acid and from about 20% to about 70% by weight unhydrolyzed fat/oil in a furnace in which the natural-oil byproduct is substituted, in whole or in part, for another type of fuel to release energy, wherein the substitution of the natural-oil byproduct decreases the emission of at least one pollutant chosen from nitrogen oxides, sulfur oxides, carbon monoxide and particulate matter to a level that provides a benefit under a pollution-emission regulation established by a regulatory agency, wherein emission of the pollutant would be above this level and access to the benefit precluded if a sufficient amount of the other type of fuel alone were burned in the furnace to release the same amount of energy; and harnessing energy released by burning the natural-oil byproduct to drive a process.

14. The method of claim 13, wherein the natural-oil byproduct is substituted in part, but not entirely, for a fuel from the following group: distillate number 2 fuel oil, residual number 6 fuel oil, and coal.

15. The method of claim 13, wherein the substitution of the natural-oil byproduct for the other fuel reduces one or more emitted pollutant concentrations to a level within a limit established by a regulatory agency, wherein burning the other fuel without the natural-oil byproduct to produce the same amount of energy would emit one or more pollutants at a concentration above the established limit.

16. The method of claim 13, wherein the ratio of the natural-oil byproduct to the other fuel that will produce emitted pollutant concentrations within established limits is determined, and at least that proportion of natural-oil byproduct is burned in combination with the other fuel.

17. The method of claim 13, wherein the natural-oil byproduct further comprises about 2% to about 5% by weight unsaponifiable impurities and about 2% to about 7% by weight oxidized, polymerized fatty materials.

18. The method of claim 13, wherein the natural-oil byproduct is substantially free of sulfur compounds and nitrogen compounds.

19. The method of claim 13, wherein the furnace is in a boiler.

20. The method of claim 13, wherein the natural-oil byproduct is mixed with at least one fuel from the following group before burning: distillate number 2 fuel oil, residual number 6 fuel oil, and coal.

21. A method for making efficient use of a natural-oil byproduct from a distilled feed composition including an animal fat, a vegetable oil, or a combination thereof, the method comprising supplying the natural-oil byproduct to an energy producer who burns the natural-oil byproduct as a substitute, in whole or in part, for another fuel to release energy and who harnesses that energy to drive a process, wherein the energy producer's substitution of the natural-oil byproduct decreases emission of at least one pollutant chosen from nitrogen oxides, sulfur oxides, carbon monoxide and particulate matter to a level that provides a benefit under a pollution-emission regulation established by a regulatory agency, wherein emission of the pollutant would be above this level and access to the benefit precluded if a sufficient amount of the other type of fuel alone were burned in the furnace to release the same amount of energy.

22. The method of claim 21, wherein the natural-oil byproduct is substituted in part, but not entirely, for a fuel from the following group: distillate number 2 fuel oil, residual number 6 fuel oil, and coal.

23. The method of claim 21, wherein substitution of the natural-oil byproduct for the other fuel enables the energy producer to produce a desired amount of energy while maintaining emitted pollutant concentrations within a limit established by a regulatory agency, wherein the energy producer would not be able to produce the desired amount of energy if burning just the other fuel without the natural-oil byproduct.

24. The method of claim 21, wherein the feed composition is hydrolyzed before distillation.

25. The method of claim 21, wherein the natural-oil byproduct comprises free fatty acid and unhydrolyzed fat/oil.

26. The method of claim 25, wherein the natural-oil byproduct further comprises unsaponifiable impurities and oxidized, polymerized fatty materials.

27. The method of claim 25, wherein the natural-oil byproduct comprises about 20% to about 50% by weight free fatty acid and from about 20% to about 70% by weight unhydrolyzed fat/oil.

28. The method of claim 27, wherein the natural-oil byproduct further comprises about 2% to about 5% by weight unsaponifiable impurities and about 2% to about 7% by weight oxidized, polymerized fatty materials.

29. The method of claim 21, wherein the natural-oil byproduct is substantially free of sulfur compounds and nitrogen compounds.

30. A clean-emissions method for generating energy comprising the steps of:

vaporizing a high-grade fatty-acid composition via distillation from a feed composition including an animal fat, a vegetable oil, or a combination thereof, leaving a non-vaporized natural-oil byproduct that comprises about 20% to about 50% by weight free fatty acid and from about 20% to about 70% by weight unhydrolyzed fat/oil;

burning the natural-oil byproduct to release energy; and harnessing energy released by burning the natural-oil byproduct to drive a process.

31. The method of claim 30, wherein the natural-oil byproduct further comprises about 2% to about 5% by weight unsaponifiable impurities and about 2% to about 7% by weight oxidized, polymerized fatty materials.

32. The method of claim 30, wherein the natural-oil byproduct is burned in a furnace in which the natural-oil byproduct is substituted, in whole or in part, for another type of fuel, the substitution of the natural-oil byproduct producing a decrease in emission of at least one pollutant from the following group: nitrogen oxides, sulfur oxides, carbon monoxide and particulate matter.

33. The method of claim 32, wherein the fuel for which the natural-oil byproduct is substituted is from the following group: distillate number 2 fuel oil, residual number 6 fuel oil, and coal.

34. A clean-emissions method for generating energy comprising the steps of:

vaporizing a high-grade fatty-acid composition via distillation from a feed composition including an animal fat, a vegetable oil, or a combination thereof, leaving a non-vaporized natural-oil byproduct, wherein the vaporized fatty acid was at least about 90% of the feed composition;

burning the natural-oil byproduct to release energy; and harnessing energy released by burning the natural-oil byproduct to drive a process.

35. The method of claim 34, wherein the natural-oil byproduct is burned in a furnace in which the natural-oil byproduct is substituted, in whole or in part, for another type of fuel, the substitution of the natural-oil byproduct producing a decrease in emission of at least one pollutant from the following group: nitrogen oxides, sulfur oxides, carbon monoxide and particulate matter.

36. The method of claim 34, wherein the fuel for which the natural-oil byproduct is substituted is from the following group: distillate number 2 fuel oil, residual number 6 fuel oil, and coal.

37. A clean-emissions method for generating energy comprising the steps of:

burning a natural-oil byproduct comprising about 20% to about 40% by weight free fatty acid, about 20% to about 70% by weight unhydrolyzed fat/oil, about 2% to about 5% by weight unsaponifiable impurities, and about 2% to about 7% by weight oxidized polymerized fatty materials to release energy; and harnessing energy released by burning the natural-oil byproduct to drive a process.

38. The method of claim 37, wherein the natural-oil byproduct is burned in a furnace in which the natural-oil byproduct is substituted, in whole or in part, for another type of fuel, the substitution of the natural-oil byproduct producing a decrease in emission of at least one pollutant from the following group: nitrogen oxides, sulfur oxides, carbon monoxide and particulate matter.

39. The method of claim 37, wherein the fuel for which the natural-oil byproduct is substituted is from the following group: distillate number 2 fuel oil, residual number 6 fuel oil, and coal.

40. A method for making efficient use of a natural-oil byproduct from a distilled feed composition including an animal fat, a vegetable oil, or a combination thereof, the natural-oil byproduct comprising about 20% to about 50% by weight free fatty acid and about 20% to about 70% by weight unhydrolyzed fat/oil, and the method comprising supplying the natural-oil byproduct to an energy producer who burns the natural-oil byproduct to release energy and who harnesses that energy to drive a process.

41. The method of claim 40, wherein the natural-oil byproduct further comprises about 2% to about 5% by weight unsaponifiable impurities and about 2% to about 7% by weight oxidized, polymerized fatty materials.

42. The method of claim 40, wherein the natural-oil byproduct is burned in a furnace in which the natural-oil byproduct is substituted, in whole or in part, for another type of fuel, the substitution of the natural-oil byproduct producing a decrease in emission of at least one pollutant from the following group: nitrogen oxides, sulfur oxides, carbon monoxide and particulate matter.

43. The method of claim 40, wherein the fuel for which the natural-oil byproduct is substituted is from the following group: distillate number 2 fuel oil, residual number 6 fuel oil, and coal.

* * * * *

UNITED STATES PATENT AND TRADEMARK OFFICE

CERTIFICATE OF CORRECTION

PATENT NO. : 7,575,608 B2
APPLICATION NO. : 10/487430
DATED : August 18, 2009
INVENTOR(S) : Angelico et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 826 days Delete the phrase "by 826 days" and insert -- by 1010 days --

Signed and Sealed this

Twenty-seventh Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,575,608 B2
APPLICATION NO. : 10/487430
DATED : August 18, 2009
INVENTOR(S) : Angelico et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1249 days.

Signed and Sealed this

Seventh Day of September, 2010

David J. Kappos

David J. Kappos
*Director of the United States Patent and Trademark Office*